US008443643B2

(12) United States Patent
Endo

(10) Patent No.: US 8,443,643 B2
(45) Date of Patent: May 21, 2013

(54) BURR REMOVING METHOD AND DEVICE

(75) Inventor: Shigeru Endo, Kanagawa (JP)

(73) Assignee: Amada Company, Limited, Kanagawa (JP)

( * ) Notice: Subject to any disclaimer, the term of this patent is extended or adjusted under 35 U.S.C. 154(b) by 0 days.

(21) Appl. No.: 13/377,693

(22) PCT Filed: May 25, 2010

(86) PCT No.: PCT/JP2010/058783

§ 371 (c)(1),
(2), (4) Date: Dec. 12, 2011

(87) PCT Pub. No.: WO2011/001762

PCT Pub. Date: Jan. 6, 2011

(65) Prior Publication Data

US 2012/0085140 A1 Apr. 12, 2012

(30) Foreign Application Priority Data

Jul. 2, 2009 (JP) ..... 2009-157589

(51) Int. Cl.
*B21D 28/16* (2006.01)
*C03B 33/027* (2006.01)

(52) U.S. Cl.
USPC ..... 72/75; 72/335; 29/90.01

(58) Field of Classification Search
USPC ..... 72/75, 133, 179, 335, 416; 101/3.1, 101/26; 29/90.01
See application file for complete search history.

(56) References Cited

U.S. PATENT DOCUMENTS 3,478,558 A * 11/1969 Miller et al. ..... 29/90.01
4,089,204 A * 5/1978 Neilsen ..... 72/412
6,131,430 A * 10/2000 Schneider et al. ..... 72/75
6,796,156 B2 * 9/2004 Natalis et al. ..... 72/75
7,168,364 B2 * 1/2007 Schneider ..... 72/75
7,367,210 B2 * 5/2008 Nishibu ..... 29/90.01
8,042,369 B2 * 10/2011 Bytow et al. ..... 72/75
2006/0042341 A1 3/2006 Nishibu

FOREIGN PATENT DOCUMENTS

| | | |
|---|---|---|
| JP | 09-122766 | 5/1997 |
| JP | 2004-358514 | 12/2004 |
| JP | 2006-095597 | 4/2006 |
| JP | 2007-000901 | 1/2007 |
| WO | 2008/136515 | 11/2008 |

* cited by examiner

*Primary Examiner* — David B Jones
(74) *Attorney, Agent, or Firm* — Greenblum & Bernstein P.L.C.

(57) ABSTRACT

A burr removing method includes: pressing, by using a work pressing device (7), the upper surface of a work (W) around a work edge (WE), along which a burr occurs, so as to be relatively freely movable, the work (W) held on a work table in a plate material processing machine so as to be freely movable in X- and Y-axis directions; when the work (W) relatively moves with respect to the work pressing device (7) in the X- and Y-axis directions, vibrating a striker (35) vertically, the striker (35) provided at a position below the work pressing device (7) so as to be freely vertically movable; and, when the striker (35) moves upward, crushing the burr. A burr removing device includes: a freely vertically movable striker (35) equipped with a burr striking portion (33) at the upper end thereof for striking a burr from the lower side and provided on a base member (29) attachable to and detachable from a work table or a die holder (5) in the plate material processing machine; and a vertical movement actuator being used for vertically moving the striker (35) and provided on the base member (29) or in a burr removing unit (37) equipped with the striker (35).

2 Claims, 3 Drawing Sheets

BURR REMOVING METHOD AND DEVICE

TECHNICAL FIELD

The present invention relates to a method and a device for removing burrs caused, for example, at a large hole periphery obtained through a punching processing or a nibbling processing by a plate material processing machine such as a punch press or at the lower part of a processing edge caused through a cutting processing. More particularly, the present invention relates to a method and a device for burr removal by which, even when a plate-like work is thin or even when the work has a small rigidity due to a small web width size for example, burrs can be removed without causing the deformation of the work.

PRIOR ART

Conventionally, when a plate material processing machine such as a turret punch press is used to perform a processing such as a punching processing, a nibbling processing, or a cutting processing, burr is caused at the lower side of the edge of this processed part (hereinafter referred to as a processing edge). In order to remove this burr, burr removing devices having various configurations have been developed. There is a disadvantage where, when a punching processing of a plate-like work is performed by a punch press and then the burr removal is performed by another burr removing device, another burr removing device is required, thus requiring a facility cost and an installation site for example.

To solve this, an approach has been known according to which a punching processing of a plate-like work by a punch press is followed by the burr removal by a burr removal tool (metal mold) provided in the same punch press (Japanese Laid-Open Publication No. 2006-95597, Japanese Laid-Open Publication No. 2007-901).

PRIOR ART PUBLICATION

Patent Publication

[Patent Publication 1] Japanese Laid-Open Publication No. 2006-95597

[Patent Publication 2] Japanese Laid-Open Publication No. 2007-901

SUMMARY OF THE INVENTION

The configuration disclosed in Patent Publication 1 is a configuration where upper and lower metal molds provided in the punch press include balls provided rotatably, respectively, and the work is relatively moved while the burr part caused in the work being sandwiched between the upper and lower balls from the upper and lower sides. The configuration disclosed in Patent Publication 2 is a configuration where the work is sandwiched from the upper and lower sides by a roller provided in an upper mold of the punch press and a cone-shaped burr contact section provided in a lower die holder of a lower mold.

Specifically, in the conventional configuration, when the burr caused in a work is sandwiched by the balls provided in the upper and lower metal molds for example, the burr removal (removal) is achieved by the plastic deformation of the burr. Thus, the work is strongly sandwiched between the upper and lower metal molds. This means that a high resistance is caused when the work is relatively moved in X and Y directions, which may cause the deformation of the work.

Thus, there is a disadvantage of the limitation on the work thickness or the web width size of the work after the processing for example.

The present invention has been made in view of the conventional disadvantage as described above. The invention provides a method of removing burrs caused at a lower face of a plate-like work processed by a plate material processing machine, comprises: supporting a work on a work table in the plate material processing machine so that the work can be moved in X axis and Y axis directions; holding, by a work holding device and in a relatively movable manner, an upper face near a processing edge at which burrs from the work are caused; and vibrating, when the work is moved relative to the work holding device in the X axis and Y axis directions, a striker provided to freely have an up-and-down motion in an up-and-down direction at a lower position of the work holding device so that the burrs are crushed by an upward motion of the striker.

The invention also provides a burr removing device for removing burrs caused at a lower face of a plate-like work processed by a plate material processing machine, comprises: a base member detachably attached to a work table or a die holder in the plate material processing machine; a striker having a burr striking unit at an upper end, the burr striking unit striking the burrs from a lower side, the striker provided at the base member to freely have an up-and-down motion; and an up-and-down movement actuator for moving the striker in an up-and-down direction, the up-and-down movement actuator provided in a burr removal unit including the base member or the striker.

According to the present invention, a striker movably provided in an up-and-down direction at the lower position of the work holding device for holding the upper face of the work in a movable manner is vibrated in the up-and-down direction and the burr is crushed by allowing the striker to strike the burr to thereby remove the burr. Thus, since the work is prevented from being always strongly sandwiched between the work holding device and the striker, the work can be smoothly moved in X and Y directions by performing the up-and-down vibration of the striker at a high speed.

EMBODIMENT FOR CARRYING OUT THE INVENTION

Figure 1:
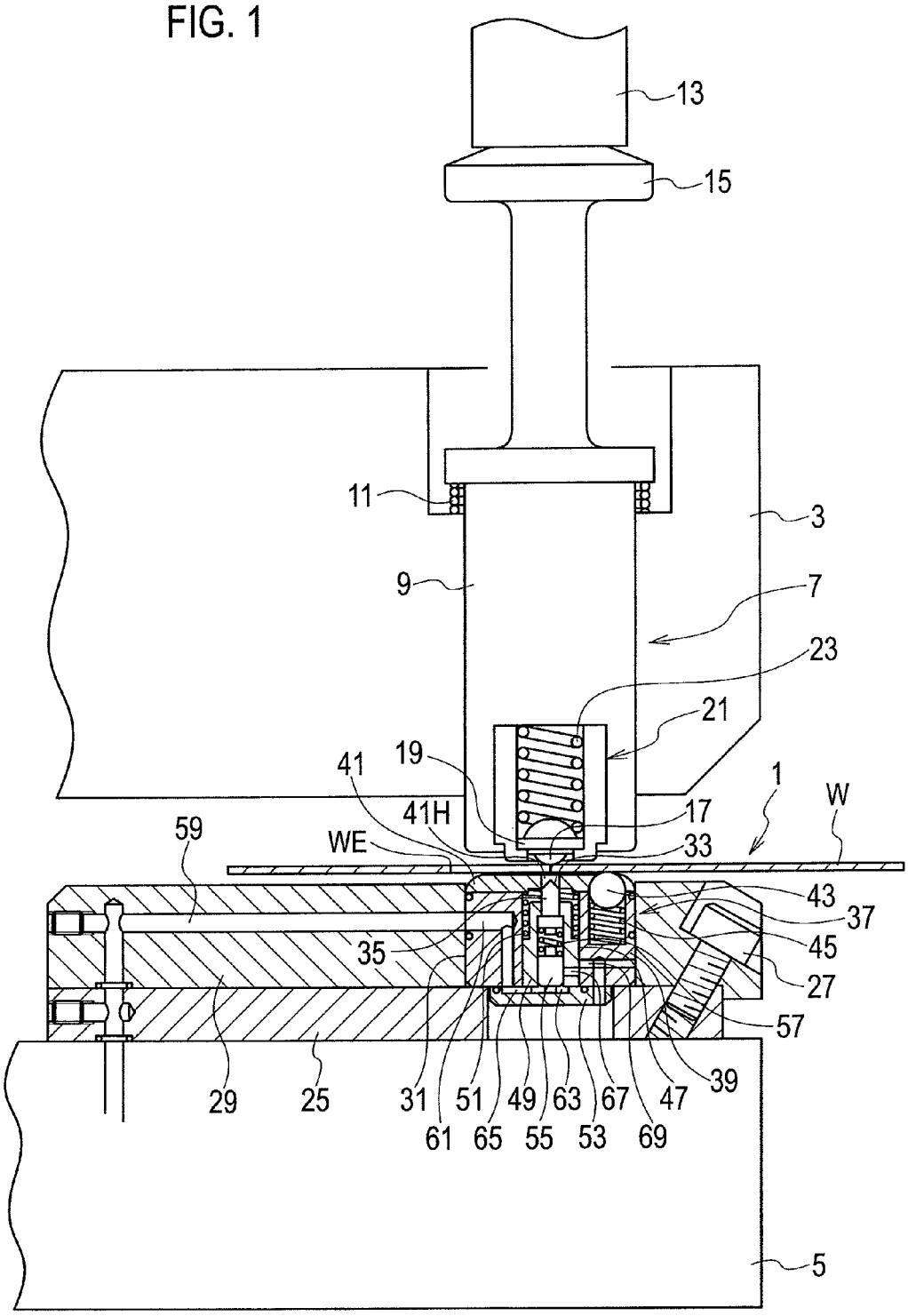
FIG. 1 is a cross-sectional view illustrating the configuration of a burr removing device according to the first embodiment of the present invention.

Referring to FIG. 1, FIG. 1 illustrates a case where a burr removing device 1 according to the first embodiment of the present invention is provided in a punch press as an example of a plate material processing machine. The punch press as an example of a plate material processing machine includes, for example, a punch holder (upper die holder) 3 such as an upper turret and a die holder (lower die holder) 5 such as a lower turret. The upper die holder 3 includes a work holding device 7 for holding the upper face near a processing edge WE subjected to a punching processing or a cutting processing of a plate-like work W supported on a work table (not shown) to be movable in the horizontal direction in the X axis and Y axis directions. In this embodiment, the X axis and Y axis directions mean a direction parallel to the plane of the plate-like work W and generally coincide with axes on the horizontal plane that are orthogonal to each other.

The work holding device 7 includes a lifting member 9 movably supported by the upper die holder 3 in an up-and-down direction. This lifting member 9 is always upwardly biased by a lifter spring 11. This lifting member 9 includes, at the upper end thereof, a head member 15 pressed by a striker (ram) 13 movably provided in the up-and-down direction in the punch press. The lifting member 9 includes, at the lower part thereof, a pressing unit 21 including a rotating body holder 19 provided movably in the up-and-down direction. The rotating body holder 19 presses the upper face of the work W and includes a rotation member 17 (e.g., a rotatable steel ball, a roller) provided in a rotatable manner. The rotating body holder 19 is always downwardly biased by an elastic member 23 such as a coil spring provided in the pressing unit 21.

A base stand 25 is provided at a position corresponding to the work holding device 7 in the upper face of the lower die holder 5. This base stand 25 has thereon a base member 29 that is detachably attached via an attachment tool 27 (e.g., a plurality of attachment bolts). A tool mounting hole 31 formed in this base member 29 includes therein a burr removal unit 37. The burr removal unit 37 includes, at the upper end thereof, a cone-shaped or curved convex-shaped burr striking unit 33 that is provided movably in the up-and-down direction to strike the processing edge WE of the work W from the lower side.

The burr removal unit 37 includes a cylindrical unit body 39 attached in the tool mounting hole 31. At a plurality of positions of this unit body 39, rotating bodies 43 (e.g., balls, rollers) for supporting the work W in a movable manner are provided. The rotating bodies 43 are rotatably provided to be slightly protruded from a hole of a cover plate 41 attached to the upper face of the unit body 39. This rotating body 43 is always upwardly biased by an elastic member 45 (e.g., a coil spring) attached in the unit body 39.

A penetration hole 47 formed in the up-and-down direction at the center of the unit body 39 includes therein a tubular slider 49 attached to be movable in the up-and-down direction. This slider 49 is always biased in the lower direction by an elastic member 51 elastically provided between the cover plate 41 and the slider 49. In a normal status, the slider is abutted to a lower plate 53 attached to the lower face of the unit body 39. An upper part of the inner hole of the slider includes therein the striker 35 that protrudes from the slider 49 in the upper direction, that can be upwardly protruded from a hole 41H provided at the center of the cover plate 41, and that can be moved in the up-and-down direction. A lower part of the inner hole of the slider 49 includes therein a striking member that downwardly protrudes from the slider 49, that can be freely abutted to the lower plate 53, and that is provided to be movable in the up-and-down direction. When the striking member 55 is at an elevated position, the striking member 55 can be freely abutted to the striker 35. An elastic member 57 is elastically provided between the striking member 55 and the striker 35.

In order to move the striker 35 in the up-and-down direction, the unit body 39 includes therein an up-and-down movement actuator. More specifically, the unit body 39 includes an air inflow hole 61 communicating with an air inflow hole 61 provided in the base member 29. This air inflow hole 61 is connected to a communication path 65 communicating with a circular opening 63 formed in the upper face of the lower plate 53. The opening 63 has a diameter larger than the diameter of the inner hole of the slider 49 so that the air pressure supplied into the opening 63 acts on the lower face of the slider 49 and the lower face of the striking member 55.

The lower part of the slider 49 has an air outflow hole 67 in the diameter direction. This air outflow hole functions to allow, when the striking member 55 is elevated against the biasing force from the elastic member 57 and is abutted to the striker 35, the inner hole of the slider 49 to communicate with the outside. The air outflow hole 67 is provided to be able to communicate with a discharge hole 69 formed in the unit body 39 when the slider 49 is elevated against the biasing force from the elastic member 51.

In the configuration as described above, when a work clamp device provided in a work positioning device (not shown) in a punch press is used to clamp the work W and the work W is moved and positioned in the X axis and Y axis directions to the processing position in the punch press and is subjected to a punching processing or a nibbling processing for example, burrs are caused at the lower part of the processing edge WE of the work W. In order to remove the burrs caused at the processing edge WE of the work W, the work holding device 7 and the burr removal unit 37 in the punch press are positioned at the processing position.

Thereafter, the processing edge WE at which the burrs from the work W should be removed by the work positioning device is positioned at a position corresponding to the striker 35 in the burr removal unit 37. Then, when the striker 13 in the punch press is lowered and the work holding device 7 is lowered, the rotation member 17 in the work holding device 7 is abutted to the upper face of the work W to thereby hold the upper part of the processing edge WE or the upper face near the processing edge WE.

As described above, when the work W is being held in a movable manner by the work holding device 7, air is supplied from the air path 59 provided in the base member 29 to the air inflow hole 61 of the unit body 39. Then, the air in the air inflow hole 61 flows into the opening 63 of the lower plate 53 to thereby apply a pressure to the slider 49 and the lower face of the striking member 55.

Thus, the slider 49 is elevated against the biasing force from the elastic member 51 and the striker 35 is elevated, thereby allowing the burr striking unit 33 of the striker 35 to be abutted to the burrs caused at the lower part of the processing edge WE of the work W. At the same time, the striking member 55 is elevated against the biasing force from the elastic member 57 and the striking member 55 is elevated and abutted to the striker 35, thereby applying an impact to the striker 35. Thus, the burrs are crushed by the burr striking unit 33 of the striker 35 and are removed.

As described above, when the slider 49 and the striking member 55 are elevated together, the air outflow hole 67 provided in the slider 49 is allowed to communicate with the discharge hole 69 of the unit body 39 and the air in the opening 63 of the lower plate 53 is discharged to the outside. Thus, the air pressure in the opening 63 decreases and the slider 49 and the striking member 55 are lowered by the biasing force from the elastic members 51 and 57 to the original lowered positions, respectively, and are returned to the initial state. Thus, the striker 35 repeats an up-and-down motion (i.e., is repeatedly vibrated in the up-and-down direction) to strike the burrs at the processing edge WE of the work W to thereby remove the burrs.

As described above, when the striker 35 is vibrated in the up-and-down direction to repeatedly strike the burrs at the processing edge WE of the work W, the work W can be relatively moved in the X and Y directions to thereby continuously remove the burrs at the processing edge WE. As described above, the striker 35 is vibrated at a high speed in the up-and-down direction to remove the burrs caused at the processing edge WE of the work W. During this, the work W is not always strongly sandwiched between the striker 35 and the work holding device 7 by being pressed by the striker 35 in the upper direction. Instead, the sandwiching of the work W is cancelled or loosened when the work W is minutely moved by the up-and-down vibration of the striker 35. Thus, the work W can be smoothly moved in the X and Y directions.

Therefore, even when the work W is a thin plate or when the work W has a small web width size, the work W can be smoothly moved in the X and Y directions without causing the deformation of the work W, thus easily removing the burrs caused at the processing edge WE of the work W.

Figure 2:
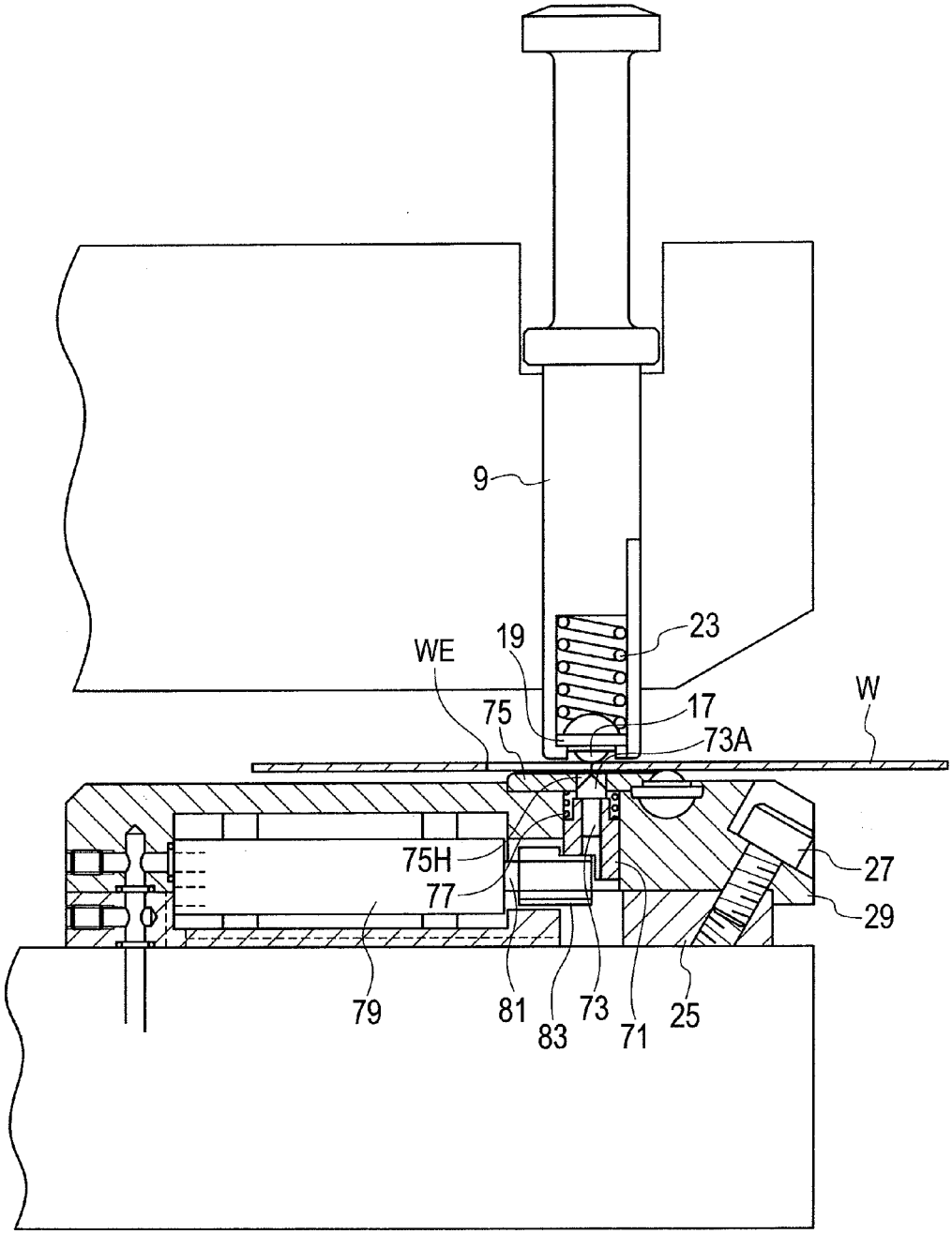
FIG. 2 is a cross-sectional view illustrating the configuration of a burr removing device according to the second embodiment of the present invention.

FIG. 2 illustrates a burr removing device according to the second embodiment of the present invention. Those components having the same functions as those in the above-described first embodiment will be denoted with the same reference numerals and will not be further described.

In the burr removing device according to this embodiment, an up-and-down slider 71 provided at the base member 29 so as to be able to freely have an up-and-down motion is integrated with a striker 73 having a burr striking unit 73A at the upper part thereof. A downward biasing force is always provided from the elastic member 77 elastically provided between the cover plate 75 attached to the upper face of the base member 29 and the up-and-down slider 71. In order to provide the up-and-down motion of the up-and-down slider 71, the base member 29 includes therein a rotary actuator 79 such as an air motor. A cam 83 integrated with the rotation axis 81 in this rotary actuator 79 is abutted to the lower part of the up-and-down slider 71.

The above configuration allows, when the cam 83 is driven to rotate by the rotary actuator 79, the rotation of the cam 83 to provide the up-and-down motion of the up-and-down slider 71. Thus, the burr striking unit 73A of the striker 73 is protruded from the hole 75H of the cover plate 75 in the upper direction to strike, by the vibration from the lower side, the burrs caused at the processing edge WE of the work W, thereby providing the same effect as that by the above-described burr removing device of the first embodiment.

Figure 3:
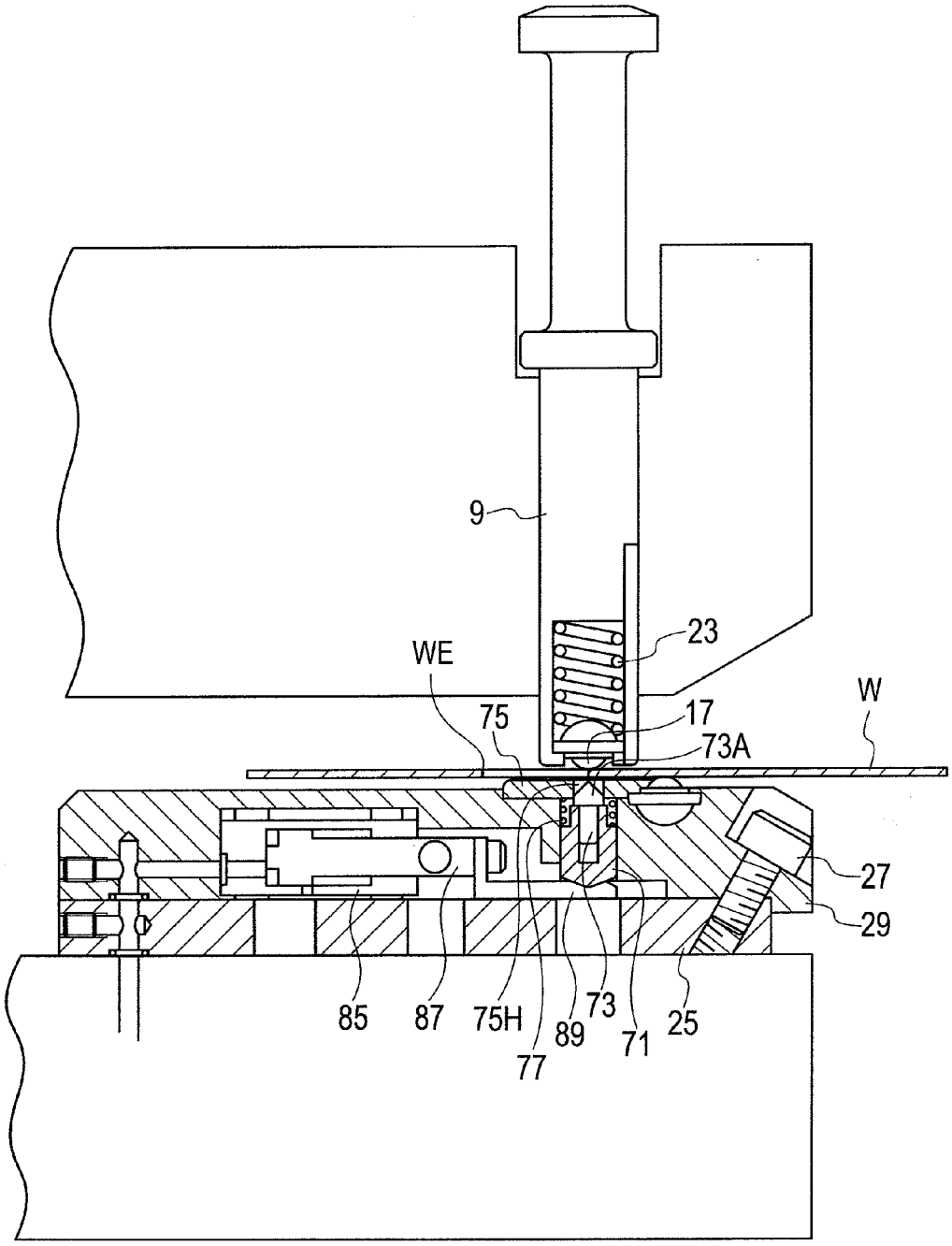
FIG. 3 is a cross-sectional view illustrating the configuration of a burr removing device according to the third embodiment of the present invention.

FIG. 3 illustrates a burr removing device according to the third embodiment. Those components having the same functions as those in the above-described burr removing device will be denoted with the same reference numerals and will not be further described.

In this third embodiment, the rotary actuator 79 is substituted with a reciprocating actuation device 85 such as an air cylinder. This reciprocating actuation device 85 has a reciprocating actuation rod 87 (e.g., a piston rod) provided in a reciprocating manner. The reciprocating actuation rod 87 is connected to a cam 89 for providing the up-and-down motion of the up-and-down slider 71.

Thus, when the reciprocating actuation device 85 is driven to reciprocate the cam 89 in the left-and-right direction in FIG. 3, the uneven surface of the cam 89 causes the up-and-down motion of the up-and-down slider 71, thus realizing the same effect as that by the above-described embodiment.

As can be seen from the description as shown above, the striker having the burr striking unit at the upper part thereof is vibrated in the an up-and-down direction to repeatedly strike and crush burrs caused at the lower side of the processing part WE of the work W, thereby removing the burrs. Thus, the burrs are not always strongly pressed by the striker so as to crush the burrs. Instead, the pressing of the work can be cancelled or loosened when the striker is minutely moved in the lower direction. Thus, the work can be smoothly moved in the X and Y directions.

In the above description, a punch press has been illustratively described as an example of a plate material processing machine. However, the invention also can be applied to a device for removing the dross caused during a laser processing by a laser processing machine. In this case, such a configuration also may be used where the burr removing device 1 is attached to a lower frame or a work table in the laser processing machine, the work holding device 7 is attached to an upper frame, and an appropriate actuator is used to lower the lifting member 9.

What is claimed is:

1. A method of removing burrs formed at a lower face of a plate-like work processed by a plate material processing machine, comprising:

supporting a plate-like work on a work table in the plate material processing machine so that the plate-like work can be moved in X axis and Y axis directions;

holding, by a work holding device and in a relatively movable manner, an upper face of the plate-like work near a processing edge of the plate-like work where the burrs form; and vibrating, when the plate-like work is moved relative to the work holding device in the X axis and Y axis directions, a striker provided to freely have an up-and-down motion in an up-and-down direction relative to the X axis and Y axis directions below the lower face of the plate-like work so that the burrs are removed by an upward motion of the striker.

2. A burr removing device for removing burrs formed at a lower face of a plate-like work processed by a plate material processing machine, comprising:

a base member detachably attached to one of a work table and a die holder in the plate material processing machine;

a striker having a burr striking unit at an upper end thereof, the burr striking unit configured to remove burrs from the lower face of the plate-like work, the striker being provided at the base member and movable in an up-and-down direction relative to the base; and an up-and-down movement actuator for moving the striker in the up-and-down direction, the up-and-down movement actuator being provided at the base member and in communication with the striker.

* * * * *